US008929751B2

(12) United States Patent
Naruse

(10) Patent No.: US 8,929,751 B2
(45) Date of Patent: Jan. 6, 2015

(54) IMAGE FORMING APPARATUS

(75) Inventor: Akira Naruse, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 92 days.

(21) Appl. No.: 13/031,791

(22) Filed: Feb. 22, 2011

(65) Prior Publication Data

US 2011/0206391 A1 Aug. 25, 2011

(30) Foreign Application Priority Data

Feb. 23, 2010 (JP) ..... 2010-036896

(51) Int. Cl.
*G03G 15/08* (2006.01)

(52) U.S. Cl.
CPC ..... *G03G 15/0858* (2013.01); *G03G 15/086* (2013.01); *G03G 15/0831* (2013.01); *G03G 2215/0888* (2013.01); *G03G 15/0839* (2013.01)
USPC ..... 399/27; 399/78

(58) Field of Classification Search
CPC ..... G03G 15/0858; G03G 15/086
USPC ..... 399/27, 28
See application file for complete search history.

(56) References Cited

U.S. PATENT DOCUMENTS 4,506,804 A * 3/1985 Oka ..... 222/64
4,592,642 A * 6/1986 Imaizumi et al. ..... 399/27
4,708,458 A * 11/1987 Ueda et al. ..... 399/59
5,436,704 A 7/1995 Moon

FOREIGN PATENT DOCUMENTS

JP 2001-100508 A 4/2001

OTHER PUBLICATIONS

Notice of Allowance issued in U.S. Appl. No. 13/032,018 dated Mar. 11, 2013.

* cited by examiner

*Primary Examiner* — Benjamin Schmitt
(74) *Attorney, Agent, or Firm* — Buchanan Ingersoll & Rooney PC

(57) ABSTRACT

An image forming apparatus includes a buffer configured to temporarily store in the buffer toner supplied from a toner cartridge and to be fed to a developing unit; a magnetic reed switch configured to sense magnet variation occurring in a sensing range and sequentially output signals each indicating a result of the sensing; a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down.

8 Claims, 6 Drawing Sheets

IMAGE FORMING APPARATUS

This application is based on application No. 2010-036896 filed in Japan, the contents of which are hereby incorporated by reference.

BACKGROUND OF THE INVENTION (1) Field of the Invention

The present invention relates to a technique for supplying toner from a toner cartridge to a development unit in an image forming apparatus, and in particular to a technique for detecting the amount of toner that remains in a toner buffer provided between the toner cartridge and the developing unit.

(2) Description of the Related Art

In image forming apparatuses, a buffer is provided between a toner cartridge and a developing unit for feeding toner from the toner cartridge to the developing unit. Such a buffer stores therein a certain amount of toner and feeds the stored toner to the developing unit in response to a request from the developing unit. The presence of the buffer is tied to the following two purposes. One is to control the amount of toner that is to be fed to the developing unit. The other is to prevent a situation where a toner shortage occurs and the image forming apparatus cannot perform any operation.

In order to supply toner from the toner cartridge to the buffer, the amount of toner that remains in the buffer is detected first, and if it is detected that only a small amount of toner remains, a predetermined amount of toner is supplied from the toner cartridge to the buffer.

As a method for detecting the amount of toner that remains in the buffer, a method using a piezo sensor and a method using an optical sensor are known. The piezo sensor is used for measuring fluctuation of a liquid level of the toner stored in the buffer, and the optical sensor is used for measuring light transparency in the buffer. Japanese Patent No. 4200612 discloses a detection method using the optical sensor.

Meanwhile, it is required for a black-and-white image forming apparatus to be produced at a lower cost than a full-color image forming apparatus. For the purpose of reducing the production cost, some black-and-white image forming apparatuses are provided with a magnetic reed switch that is more economical than the optical sensor. The magnetic reed switch is turned ON and OFF in response to a change in magnetic field (i.e. magnetic variation) occurred in a sensing range.

Specifically, a toner level indicator plate is swingably disposed within the buffer to swing up and down about a fixed point in response to a change in a liquid level of the toner that remains in the buffer. A magnet is attached to a free edge of the toner level indicator plate. The magnetic reed switch is positioned at such a level that the magnet is made to face the magnetic reed switch in a state where the detection plate has swung down. As the liquid level of the toner is lowered, the detection plate along with the magnet moves down. At this time, the magnet brings about the change in the magnetic field. In response to the change in the magnetic field, the signal output from the magnetic reed switch is switched. As a result, it is detected that the amount of toner that remains in the buffer is small.

Recently, due to a need to reduce production costs, there is an increasing demand for using such a reasonable magnetic reed switch for the detection of the amount of toner in the full-color image forming apparatus as well.

Inside a full-color image forming apparatus, a toner cartridge, a buffer, a developing unit, and others are disposed for each of yellow (Y), magenta (M), cyan (C) and black (K).

Compared with a black-and-white image forming apparatus, the full-color image forming apparatus has less layout flexibility for the above-mentioned components that are situated closely to each other. In such a structure, if a magnetic reed switch is used for detecting the amount of toner that remains in a buffer, it may be inevitable to situate the motor close to the magnetic reed switch.

However, situating the motor close to the magnetic reed switch poses a problem that the magnetic reed switch is affected by a change in magnet field caused by a rotational movement of the motor and sequentially outputs a signal indicating ON/OFF. As a result, the image forming apparatus cannot appropriately detect the amount of toner that remains in the buffer. This hinders appropriate control of toner supply from the toner cartridge to the toner buffer.

SUMMARY OF THE INVENTION

One aspect of the present invention provides an image forming apparatus comprising: a buffer configured to temporarily store therein toner supplied from a toner cartridge and to be fed to a developing unit; a magnetic reed switch configured to sense magnet variation occurring in a sensing range and sequentially output signals each indicating a result of the sensing; a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down; a detection unit configured to detect, at equal intervals, each signal output from the magnetic reed switch, each interval being equal to one-Nth of a period of a control pulse signal used for driving a motor positioned within the sensing range, N being an integer two or greater; and a determination unit configured to determine, when a signal detected by the detection unit in a current period indicates that the magnet reed switch has sensed magnetic variation, whether the signal is output due to a toner shortage or the driving of the motor, with use of signals detected by the detection unit over the last N periods.

Another aspect of the present invention provides a full-color image forming apparatus comprising for each of a plurality of colors: (i) a toner storage unit configured to temporarily store therein toner supplied from a toner cartridge and to be fed to a developing unit, including: a buffer configured to temporarily store therein toner; a magnetic reed switch configured to sense magnet variation occurring in a sensing range and sequentially output signals each indicating a result of the sensing; a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down; a motor; and a feed unit configured to supply the toner stored in the buffer to the developing unit in response to driving of the motor; (ii) a detection unit configured to detect, at equal intervals, each signal output from the magnetic reed switch, each interval being equal to one-Nth of a period of a control pulse signal used for driving a motor positioned within the sensing range, N being an integer two or greater; and (iii) a determination unit configured to determine, when a signal detected by the detection unit in a current period indicates that the magnet reed switch has sensed magnetic variation, whether the signal is output due to a toner shortage or the driving of the motor, with use of signals detected by the detection unit over the last N periods.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes an image forming apparatus according to a preferred embodiment of the present invention.

<Overall Structure>

Figure 1:
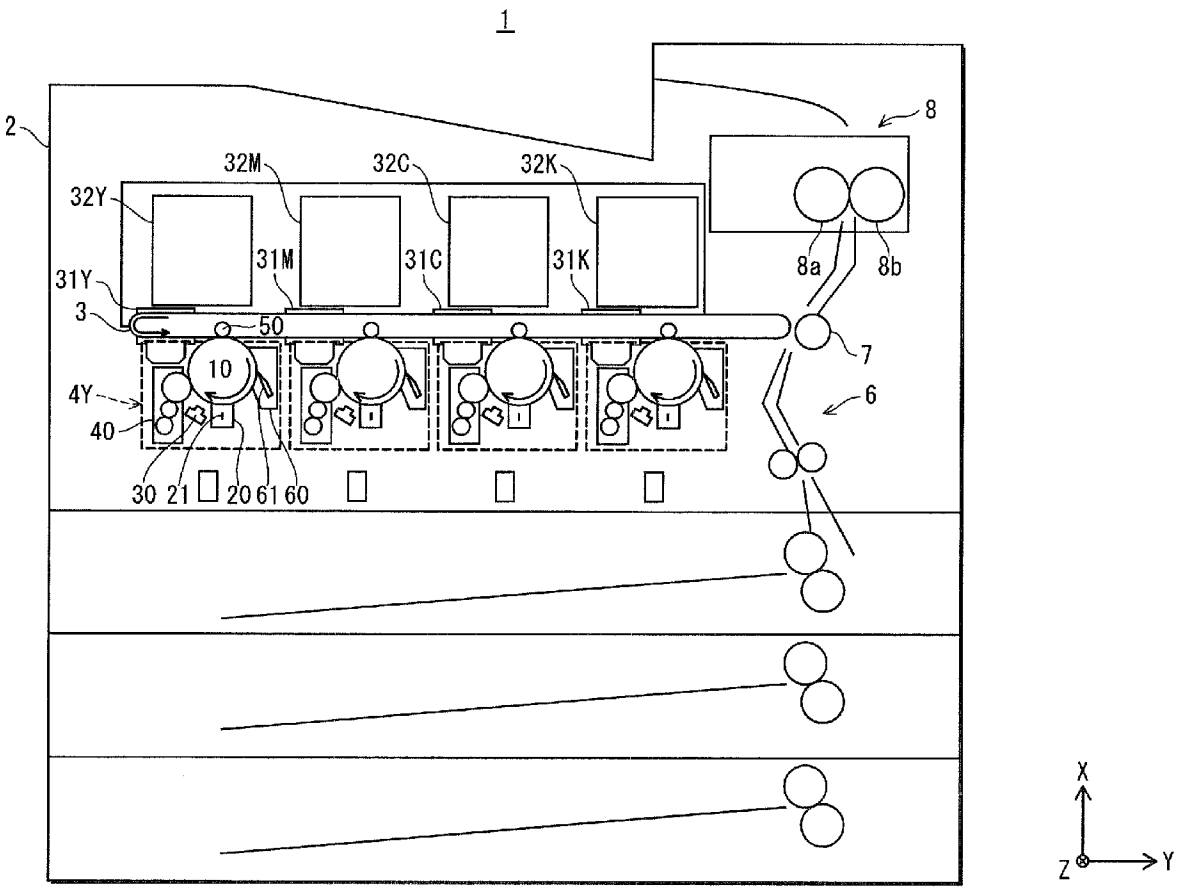
FIG. 1 shows a schematic structure of an image forming apparatus 1 that depicts an embodiment of the present invention.

FIG. 1 is a schematic view showing an overall structure of the image forming apparatus according to the present embodiment.

As shown in FIG. 1, the image forming apparatus 1 according to the present embodiment is a tandem-type full-color digital printer using a well-known electrophotographic method. The image forming apparatus 1 includes a body 2. The body 2 includes an intermediate transfer belt 3, a plurality of toner cartridges 32Y, 32M, 32C, and 32K, a plurality of toner storage units 31Y, 31M, 31C, and 31K, a plurality of process units 4, a feeder 6, a secondary transfer roller 7, a fixing unit 8, and others.

The intermediate transfer belt 3 is an endless belt that is made of an insulating resin sheet and that runs around a plurality of rollers (not shown). The intermediate transfer belt 3 is driven to rotate in a direction shown by an arrow of FIG. 1 by one of the rollers being rotated by a driving means (not shown).

The toner cartridges 32Y, 32M, 32C, and 32K are detachable from the body 2, and filled with toner (i.e. developers) of yellow, magenta, cyan and black, respectively. The toner of each color is supplied from a corresponding one of the toner cartridges 32Y, 32M, 32C, and 32K to a corresponding one of the toner storage units 31Y, 31M, 31C, and 31K, in accordance with control performed by later-described control unit 107 and a toner supply unit 108 (see FIG. 4). The details of the toner supply control of the will be described later.

The toner storage units 31Y, 31M, 31C, and 31K are each situated between the corresponding toner cartridge and a developing unit 40 included in a corresponding one of the process units 4. The toner storage units 31Y, 31M, 31C, and 31K each store therein a certain amount of toner, and feed an appropriate amount of the stored toner to the corresponding developing unit 40. The details of the toner storage units 31Y, 31M, 31C, and 31K will be described later.

One process unit 4 is provided for each of yellow (see 4Y of FIG. 1), magenta, cyan and black, and a total number of the process units 4 is four. These four process units are disposed in series along the intermediate transfer belt 3 such that each process unit faces the intermediate transfer belt 3 with a predetermined gap therebetween.

Each process unit 4 includes a photosensitive drum 10, a charger 20, an exposure unit 30, a developing unit 40, a primary transfer roller 50, and a cleaner 60. Each process unit 4 forms a toner image in the corresponding color.

The photosensitive drum 10 acting as an image carrier has a cylindrical shape having an outer diameter from 20 to 100 mm, and has an outer circumferential surface on which a photosensitive layer is formed. The photosensitive drum 10 is driven to rotate in the direction shown by the arrow of FIG. 1.

The charger 20 is a contactless charger that generates discharge between the charger 20 and the photosensitive drum 10 to charge the outer circumferential surface of the photoconductor drum 10 to a predetermined electrical potential. The charger 20 includes a discharge electrode 21 and others.

The exposure unit 30 irradiates the outer circumferential surface of the photosensitive drum 10 with a laser beam corresponding to a time-series electrical digital pixel signal composing image data, thus forming an electrostatic latent image.

The developing unit 40 develops the formed electrostatic latent image by supplying the toner to the outer circumferential surface of the photosensitive drum 10. The developing unit 40 can be either contact-type or contactless-type, and the development method can be either two-component development using toner and carriers or one-component development without using carriers.

The primary transfer roller 50 is disposed to oppose the photosensitive drum 10 with the intermediate transfer belt 3 therebetween. The primary transfer roller 50 transfers the toner image formed on the outer circumferential surface of the photosensitive drum 10 to the intermediate transfer belt 3 by means of electrical field and pressure.

The cleaner 60 cleans off unwanted toner from the outer circumferential surface of the photosensitive drum 10, by bringing a blade of the cleaner 60 into contact with the photosensitive drum 10. The toner cleaned is collected inside the cleaner 60. Note that the unwanted toner herein refers, for example, to toner that is left due to a transfer failure and toner dust.

The feeder 6 feeds a recording sheet (not shown) to a secondary transfer position timely in accordance with a secondary transfer performed as follows.

The secondary transfer roller 7 transfers the toner image formed on the outer circumferential surface of the intermediate transfer belt 3 to the recording sheet fed to the secondary transfer position.

The fixing unit 8 includes a pair of fixing rollers 8*a* and 8*b* that are rotatable disposed to face each other and rotate in an abutting state. The recording sheet passes between the fixing rollers 8*a* and 8*b*, and heated and pressed by the rollers 8*a* and 8*b*. By this means, the toner image is fixed onto the recording sheet.

<Structure of Toner Storage Unit>

A description is next given of the toner storage units 31.

Figure 2:
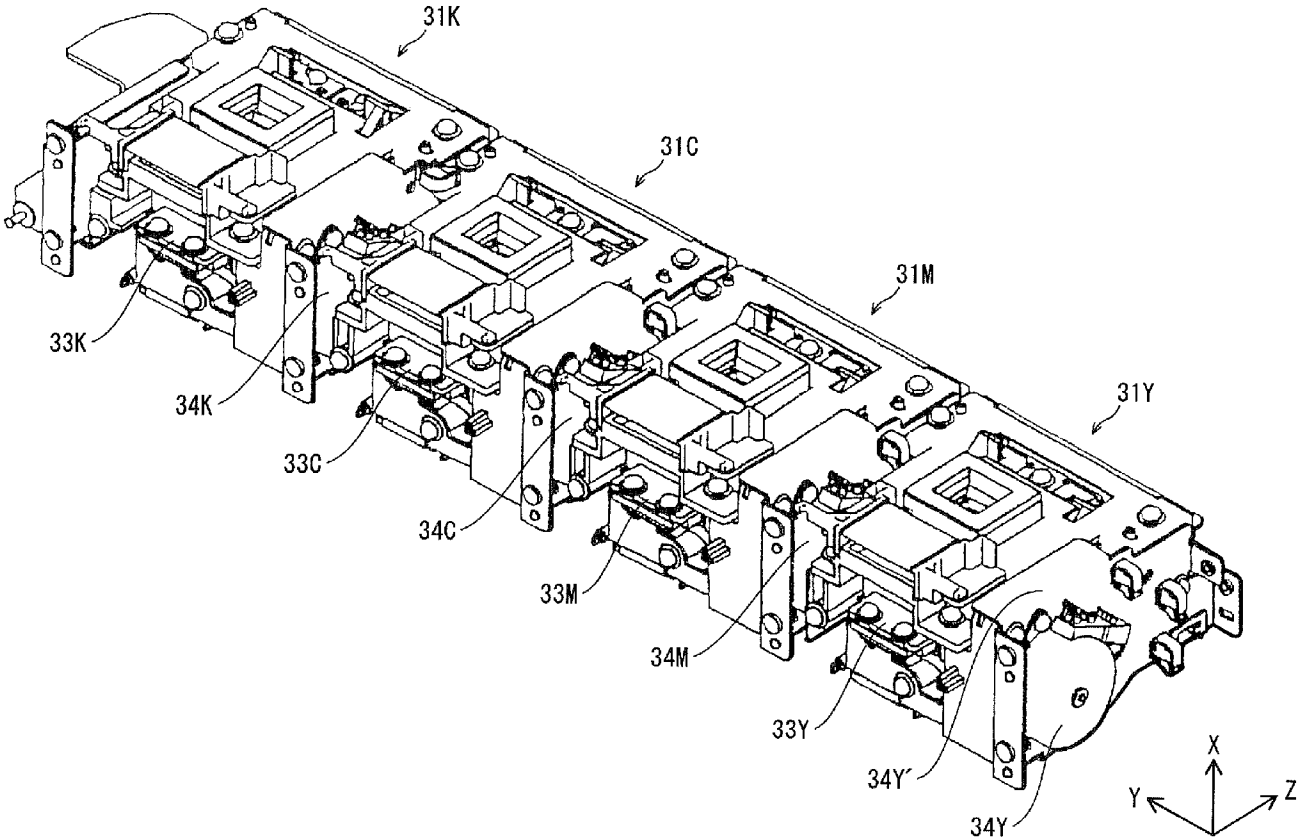
FIG. 2 is a perspective view showing toner storage units 31Y, 31M, 31C, and 31K.

FIG. 2 is a perspective view showing the toner storage units 31Y, 31M, 31C, and 31K. In order to meet a demand for downsizing the image forming apparatus, the toner storage units are disposed in the body 2 close to each other as shown in FIG. 2.

The toner storage units 31Y, 31M, 31C, and 31K are respectively provided with magnetic reed switches 33Y, 33M, 33C, and 33K for detecting the amount of toner that remains in the units 31Y, 31M, 31C, and 31K.

Each magnetic reed switch 33Y, 33M, 33C, or 33K is composed mainly of a pair of magnetizable reeds and an inert gas sealed in a glass tube such that the pair of magnetizable reeds each have a contact portion overlapped in parallel by a predetermined length, and are separated by a predetermined air gap when the contact portions are open. In the magnetic reed switch, in response to application of magnet field generated by a magnet and a coil, the pair of magnetizable reeds is magnetized. This forms opposite poles of an N-pole and an S pole at the contact portions of the pair of magnetizable reeds. If the magnetic attractive force present between the poles is greater than mechanical elasticity of the pair of magnetizable reeds, the contact portions are closed. In this case, a signal indicating ON (i.e. ON signal) is output. On the other hand, if the magnetic field is removed, the contact portions are opened due to the mechanical elasticity. In this case, a signal indicating OFF (i.e. OFF signal) is output.

Further, motors 34Y, 34M, 34C, and 34K are respectively fixed to the toner storage units 31Y, 31M, 31C, and 31K by means of a metal attachment member. The motor 34Y is used to actuate a feed screw used for feeding toner from the toner storage unit 31Y to the developing unit 40. The same applies to 34M and 31M, 34C and 31C, and 34K and 31K. Each motor is driven to rotate in response to a control pulse signal from the control unit 107 having a predetermined period T'.

The motor 34Y and the motor 34M are disposed close to the magnetic reed switch 33Y. In the present embodiment, however, the metal motor attachment member 34Y' shields the magnetic reed switch 33Y from magnetic field generated by the motor 34Y. Accordingly, the magnetic reed switch 33Y is affected only by magnetic variation caused by a rotational movement of the motor 34M provided for the adjacent color (i.e. magenta). Specifically, in response to the rotational movement of the motor 34M, the magnetic reed switch 33Y sequentially outputs an ON/OFF signal at every period T'.

Similarly, the magnetic reed switch 33M is affected by the magnetic variation caused by the rotational movement of the adjacent motor 34C. The magnetic reed switch 33C is affected by the magnetic variation caused by the rotational movement of the adjacent motor 34K.

A description is next given of the details of the toner storage units 31.

Figure 3:
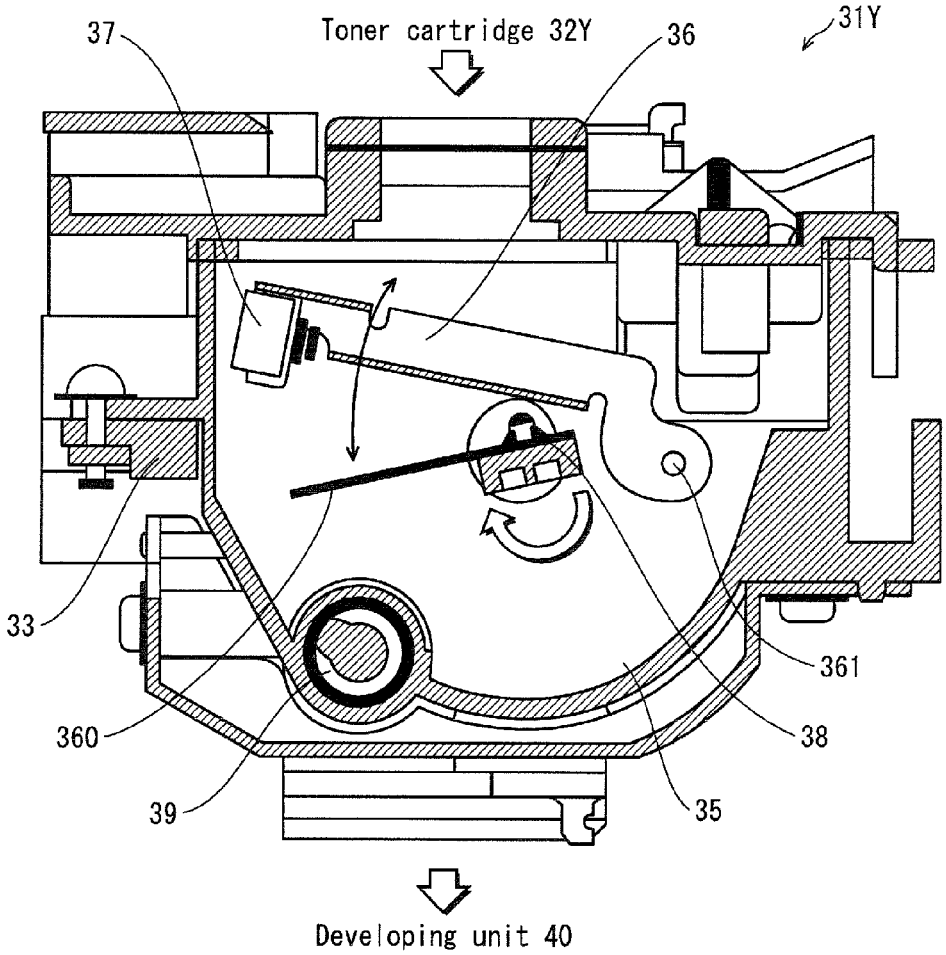
FIG. 3 is a section view of the toner storage unit 31Y.
Figure 3:
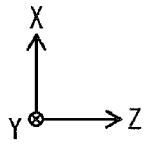

FIG. 3 is a section view of the toner storage unit 31Y taken along an X-Z plane in FIG. 2. Note that the toner storage units 31M, 31K, and 31C have the same structure as the toner storage unit 31Y, and an alphabetical letter indicating a toner color is omitted below.

As shown in FIG. 3, the toner storage unit 31 includes the magnetic reed switch 33, a toner buffer 35, a toner level indicator plate 36, the magnet 37, a cam 38, the feed screw 39, and a agitator fin 360.

The toner buffer 35 is a hopper for temporarily storing therein toner supplied from the toner cartridge 32Y located upstream in a toner supply direction.

The toner level indicator plate 36 is swingably supported by a swing shaft 361 (i.e. a fixed point). In conjunction with a rotation of the cam 38, the toner level indicator plate 36 swings up and down about the swing shaft 361.

The magnet 37 is attached to a free edge the toner level indicator plate 36. As the toner level indicator plate 36 swings up and down about the swing shaft 361, the magnet 37 attached to the free edge is moved upward and downward accordingly. On each rotation of the cam 38, the toner level indicator plate 36 is first swung up above a liquid level of the toner stored in the toner buffer 35 along with the magnet 37, and then descends until it reaches the liquid level of the stored toner. The toner level indicator plate 36 and the magnet 37 are held at the liquid level of the stored toner for the meanwhile. Thereafter, as the amount of toner that remains in the toner buffer 35 decreases and the liquid level of the toner is lowered, the toner level indicator plate 36 along with the magnet 37 swings down accordingly.

When the toner is supplied from the toner cartridge 32 to the toner buffer 35, the toner level indicator plate 36 and the magnet 37 are buried in the supplied toner. Subsequently, in conjunction with a full rotation of the cam 38, the toner level indicator plate 36 along with the magnet 37 is swung up above the surface of the supplied toner liquid, and then descends until it reaches the liquid level of the toner stored in the toner buffer 35. The toner level indicator plate 36 and the magnet 37 are held at the liquid level of the toner for the meanwhile.

The magnetic reed switch 33 is positioned at such a level that the free edge of the toner level indicator plate 36 (i.e. the magnet 37) is made to face the magnetic reed switch 33 after swinging down. This allows the magnetic reed switch 33 to sense the magnetic variation caused by the magnet 37, if the magnet 37 is moved downward to reach such a level as to face the magnetic reed switch 33 due to a decrease in the toner that remains in the toner buffer 35. The magnetic reed switch 33 is configured to output an ON signal when the magnet 37 is moved downward toward the magnetic reed switch 33 and output an OFF signal when the magnet 37 is moved upward away from the magnetic reed switch 33.

The feed screw 39 is used for feeding the toner from the toner buffer 35 to the developing unit 40. The feed screw 39 is actuated by the motor 34Y. An appropriate amount of the toner stored in the toner buffer 35 is fed to the developing unit 40 by means of the feed screw 39.

The agitator fin 360 is a resin fin for agitating the toner stored in the toner buffer 35. The agitator fin 360 is attached to the cam 38 to swing up and down as the cam 38 rotates. This allows the agitator fin 360 to agitate the toner stored in the toner buffer 35.

<Functional Structure>

Figure 4:
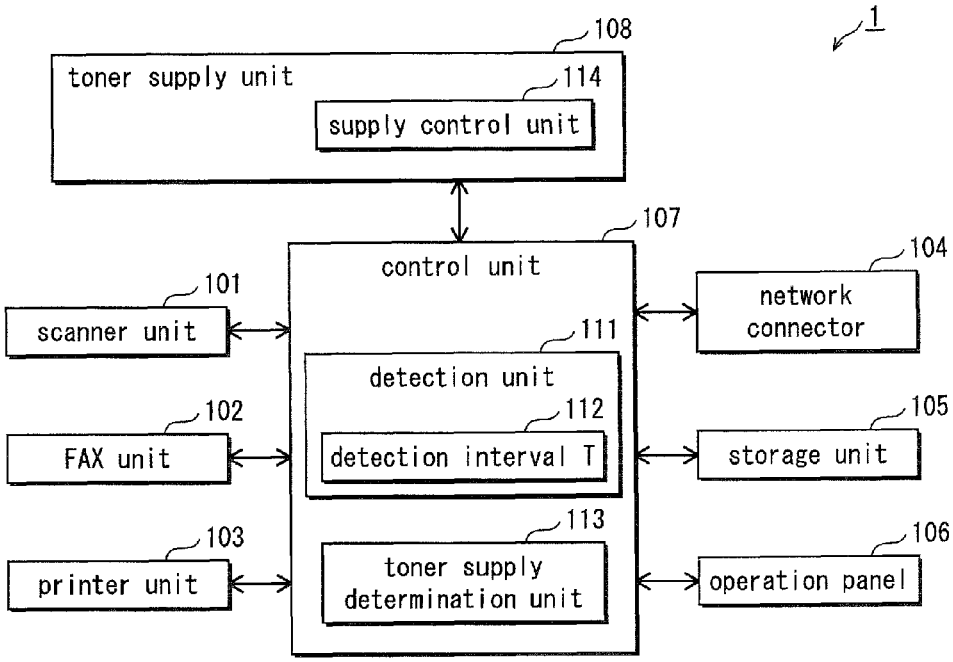
FIG. 4 is a functional block diagram showing a functional structure of the image forming apparatus 1.

FIG. 4 is a functional block diagram showing a functional structure of the image forming apparatus 1. As shown in FIG. 4, the image forming apparatus 1 includes a scanner unit 101, a FAX unit 102, a printer unit 103, a network connector 104, a storage unit 105, an operation panel 106, the control unit 107, and the toner supply unit 108.

The scanner unit 101 includes a platen, an image reader, and others. In response to a request for scan processing received by the control unit 107, the image reader reads an image, such as a letter, a figure, or a photograph, from an original placed on the platen. Thus, the image data composed of electrical data is generated. The scanner unit 101 may have an ADF (Auto Document Feeder) for conveying a plurality of original documents placed on a original receiving tray one by one to the platen.

The FAX unit 102 functions as a modem for transmitting and receiving the image data via a public line.

Upon a request for print processing received by the control unit 107, the printer unit 103 prints the data converted for the purpose of printing, and outputs the printed data as a paper document. The printer unit 103 may also have a finisher having a finishing function, such assorting, punching, and stapling.

The network connector 104 has, for example, an Ethernet™ port for connecting the image forming apparatus 1 to a LAN (Local Area Network), and an interface for setting up a parallel port connection between the image forming apparatus 1 and a PC (Personal Computer).

The storage unit 105 is composed mainly of a HDD, and stores therein various data, such as the image data, a FAX number, an email address, and an email.

The operation panel 106 includes a ten key, various bottoms, a touch pad liquid crystal display, and others. The operation panel 106 is a control device for a user to operate the image forming apparatus 1. The operation panel 106 generates input information in response to a user operation, and notifies the control unit 107 of the generated input information. The operation panel 106 further receives various screen information from the control unit 107, and displays the received screen information on the liquid crystal display.

The control unit 107 is composed mainly of a CPU, a ROM, a RAM, and a HDD. The HDD or the ROM stores therein various computer programs for the image forming apparatus 1 to function. Such computer programs include a total control program, an image processing program, and a toner supply control program. The control unit 107 controls the other units, by the CPU implementing the various computer programs using the RAM created for the operation of the programs. By doing so, the control unit 107 controls the function and the operation of the image forming apparatus 1 as a whole.

Further, the control unit 107 includes a detection unit 111 and a toner supply determination unit 113, both of which have functions characteristic of the present invention.

The detection unit 111 holds therein a detection interval T (112) in advance, and detects a signal output from each of the magnetic reed switches 33Y, 33M, 33C, and 33K provided for the corresponding color at equal intervals T. The detection interval T equals to half of a period T' of the control pulse signal used for driving the motor 34Y, 34M, 34C, and 34K (i.e. T=T'/2).

The detection unit 111 detects an ON signal or OFF signal output from each magnet reed switch, and outputs, to the toner supply determination unit 113, the detected ON signal or OFF signal (may be referred to below as a "detected signal") generated by each magnetic reed switch.

In response to the detected ON signal output from the detection unit 111, the toner supply determination unit 113 determines whether or not to supply the toner from the toner cartridge to the toner storage unit. Note that the toner supply determination unit 113 holds therein the detected signals previously detected over a certain number of periods required for the determination. Specifically, in the present embodiment, the toner supply determination unit 113 holds the detected signals previously detected over the last two periods with respect to each color. The toner supply determination unit 113 determines whether or not to supply the toner with use of the detected signals obtained over the last two periods.

If it is determined that the toner is to be supplied, the toner supply determination unit 113 specifies a color (i.e. one of yellow, magenta, cyan and black), and instructs the toner supply unit 108 to supply the toner in the specified color.

The toner supply unit 108 includes the toner cartridge, the toner storage unit, a supply control unit 114 for rotating the toner cartridge, and others. In response to the toner supply instruction received from the toner supply determination unit 113, the supply control unit 114 rotates the toner cartridge of the specified color for a predetermined period of time. This allows a predetermined amount of toner to be supplied to the toner storage unit.

Meanwhile, in the present embodiment, the detection interval T is set to satisfy T=T'/2, and the determination about the toner supply is performed with use of the detected signals obtained in the last two periods. This arrangement is intended for the toner supply to be appropriately controlled even in the following case. That is to say, despite that the motor 34M is driven to rotate for the purpose of the toner supply, the magnetic reed switch 33Y is affected by the magnetic variation caused by the motor 34M and sequentially outputs an ON/OFF signal at every period T'.

<Operations>

Figure 5:
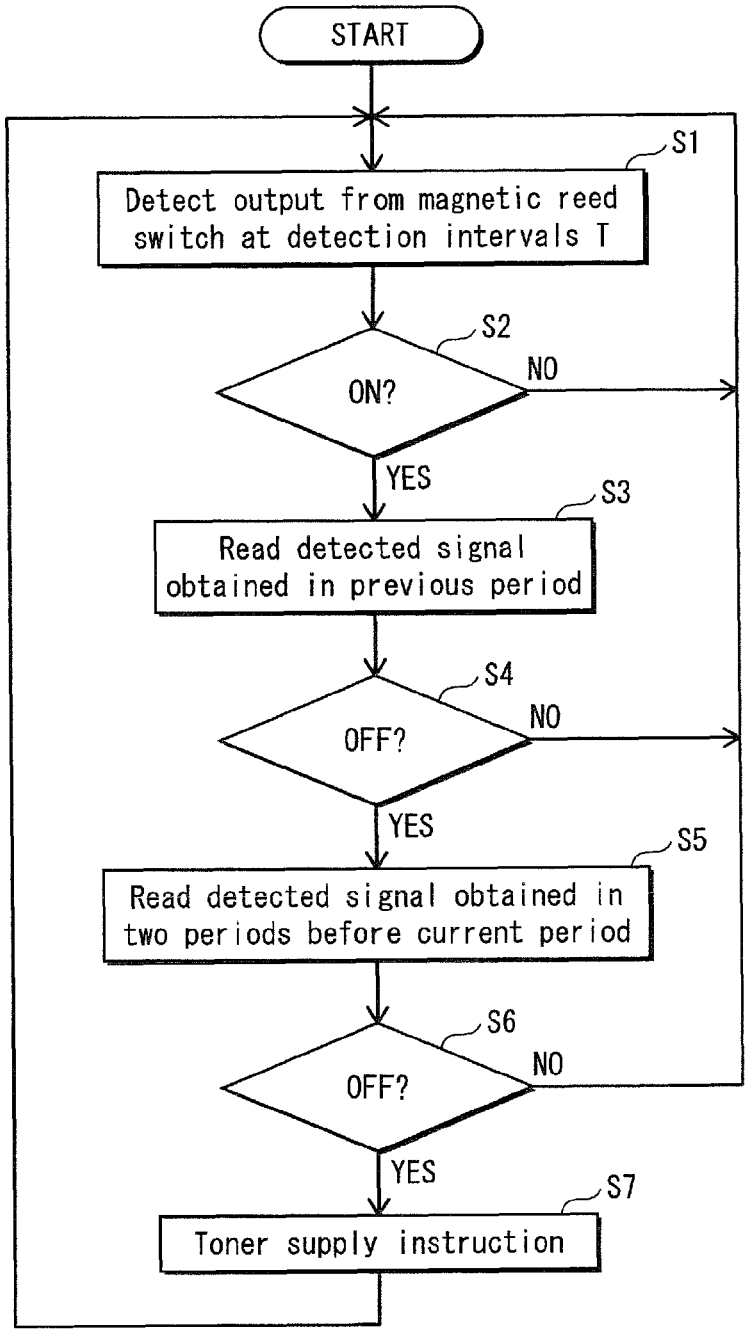
FIG. 5 is a flowchart showing an operation of toner supply processing performed by the image forming apparatus 1.

Next, with reference to a flowchart of FIG. 5, a description is given of a toner supply operation performed by the image forming apparatus 1. Note that the description below is directed to the yellow (Y) color for the sake of descriptive convenience. In fact, however, the image forming apparatus 1 performs the toner supply processing through steps S1 to S7 with respect to each color.

The detection unit 111 detects a signal output from the magnetic reed switch 33Y at the predetermined detection intervals T(112) (step S1). The detection unit 111 outputs each signal detected in the step S1 to the toner supply determination unit 113.

If a signal detected in a current period in the step S1 indicates OFF (NO in step S2), the processing returns to the step S1. If the detected signal output from the magnetic reed switch 33Y indicates OFF, this means that the magnet 37 attached to the toner detection plate 36 has not moved downward to such a level as to face the magnetic reed switch 33Y. In other words, it is determined that the liquid level of the toner stored in the toner buffer 35 is not lowered yet to a level at which the toner supply is required.

If the signal detected in the step S1 indicates ON (YES in the step S2), the toner supply determination unit 113 reads the detected signal obtained in the previous period (step S3). If the detected signal obtained in the previous period also indicates ON (NO in step S4), the processing returns to the step S1.

It is an appropriate time (may be referred to below as an On-edge) to perform the toner supply when the detected signal output from the magnetic reed switch 33Y switches from OFF to ON as a result of the toner level indicator plate 36 having swung down along with the magnet 37. In the case where the two successively detected signals both indicate ON, this means that the ON signal detected in the step S1 does not indicate the On-edge. In this case, it is not necessary to supply the toner.

If the detected signal obtained in the previous period and read in the step S3 indicates OFF (YES in the step S4), the toner supply determination unit 113 further reads the detected signal obtained in the two periods before the current period (step S5). If the detected signal obtained in the two periods before the current period also indicates ON (NO in step S6), the processing returns to the step S1.

In the case where the three successively detected signals indicate ON, OFF, and ON over time, it is considered that the ON signal detected in the step S1 does not indicate the On-edge due to the decrease in the toner. Rather, it is considered that the ON signal detected in the step S1 indicates the noise caused by the rotational movement of the motor 34M. In this case, it is not necessary to supply the toner.

In the case where the detected signal in the step S5 obtained in the two periods before the current period indicates OFF (YES in the step S6), the toner supply determination unit 113 specifies the yellow color and instructs supply control unit 114 of the toner supply unit 108 to supply the yellow toner (step S7). In response to the toner supply instruction received from the toner supply determination unit 113, the supply control unit 114 performs control so that an appropriate amount of the toner is supplied from the toner cartridge 32Y to the toner buffer 35Y.

In the case where the three successively detected signals indicate OFF, OFF, and ON over time, it is considered that the ON signal detected in the step S1 indicates the On-edge due to the decrease in the toner, not the noise caused by the motor 34M. In this case, it is necessary to supply the toner.

<Effects>

Now, with reference to FIG. 6, a description is given of advantageous effects of the present embodiment.

Firstly, conventional toner supply determination processing is described. It is assumed that in a conventional image forming apparatus the detection interval is set to be T0. In other words, in this description, the conventional control unit detects a signal output from the magnetic reed switch at every T0 seconds. Upon detection of an ON signal output from the magnetic reed switch, the conventional control unit determines whether or not the detected ON signal indicates the On-edge, by checking which one of ON and OFF the signal obtained in the previous period indicates.

Figure 6A:
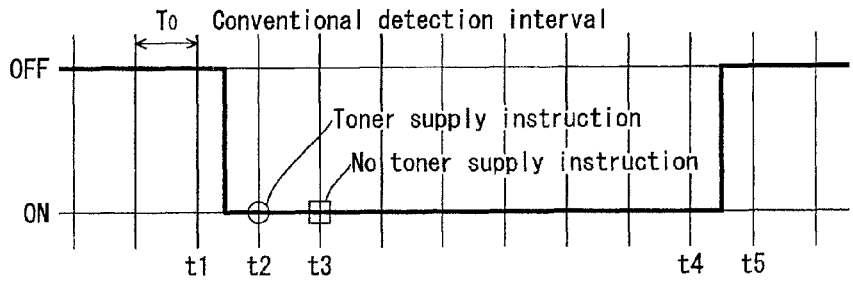
FIG. 6A PRIOR ART
FIG. 6A is a view drawn for illustrating toner supply determination processing performed by a conventional image forming apparatus.

FIG. 6A is a waveform diagram showing the signals sequentially output from the magnetic reed switch in the case where the magnetic reed switch is not affected by the noise. According to FIG. 6A, the magnetic reed switch continues to output an OFF signal until a time point t1, and at a time point t2, outputs an ON signal. Then, for a period from a time point t3 to a time point t4, the magnetic reed switch continues to output an ON signal, and at a time point t5, outputs an OFF signal again.

In this case, upon detection of the ON signal at the time point t2, the control unit checks the detected signal obtained in the previous period, that is to say, at the time point t1. Since the detected signal obtained at the time point t1 indicates OFF, it is determined that the ON signal detected at the time point t2 indicates the On-edge. The control unit then instructs the toner supply from the toner cartridge to the toner storage unit.

Figure 6B:
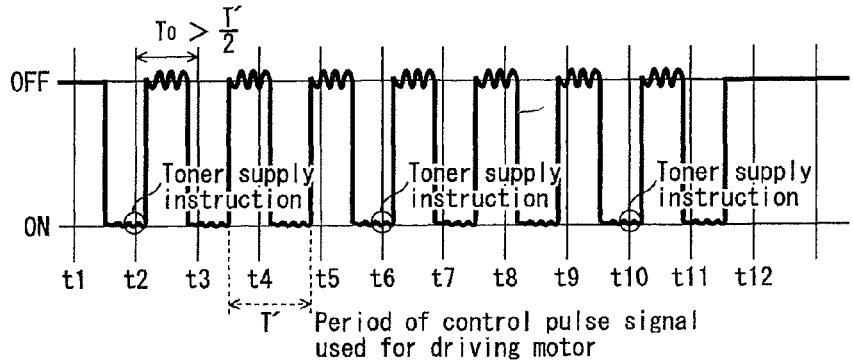
FIG. 6B is a view drawn for illustrating the toner supply determination processing performed by the conventional image forming apparatus in the case where the determination is affected by noise of a motor.

FIG. 6B is a waveform diagram showing the signals sequentially output from the magnetic reed switch in the case where the motor situated close to the magnetic reed switch is driven to rotate. Here, it is assumed that the period of the control pulse signal used for driving the motor is set to be T', and the detection interval T0 satisfies T0>T'/2. As shown in FIG. 6B, the magnetic reed switch continues to output an OFF signal until a time point t1, and at a time point t2, outputs an ON signal as a result of the toner level indicator plate along with the magnet having swung down. Subsequently, the motor situated close to the magnetic reed switch is driven to rotate. Then, the magnetic reed switch sequentially outputs an ON/OFF signal at every period T' of the control pulse signal.

In this case, upon detection of the ON signal at the time point t2, the control unit checks the detected signal obtained in the previous period, that is to say, at the time point t1. Since the detected signal obtained at the time point t1 indicates OFF, it is determined that the ON signal detected at the time point t2 indicates the On-edge. The control unit then instructs the toner supply from the toner cartridge to the toner storage unit.

In the case where the control unit detects an ON signal at time points t3, t7, and t11, the detected signal obtained in the previous period of each of the detected ON signals is checked. Since the detected signals obtained in the respective previous periods indicate ON, it is determined that the ON signals detected at the time points t3, t7, and t11 do not indicate the On-edge. Accordingly, the toner supply is not instructed.

In the case where the control unit detects an ON signal at time points t6 and t10, the detected signal obtained in the previous period of each of the detected ON signals is checked. Since the detected signals obtained in the respective previous periods indicate OFF, it is determined that the ON signals detected at the time points t6 and t10 indicate the On-edge. Accordingly, the toner supply is instructed.

In this way, under the condition that the detection interval T0 satisfies T0>T'/2, the control unit determines in error that the time points t6 and t10 indicate the On-edge, despite the fact that the time points t6 and t10 are not the On-edges. Based on the erroneous determination, the control unit instructs the toner supply.

This brings about a problem that the toner is fed from the toner cartridge to the toner storage unit despite the fact that the toner storage unit is still filled with an adequate amount of toner. As a result, on the contrary to the fact that the toner still remains in the toner cartridge, the control unit acknowledges in error that a toner shortage has occurred in the toner cartridge. Accordingly, an indication "toner replacement" is output to be displayed on the operation panel.

Figure 6C:
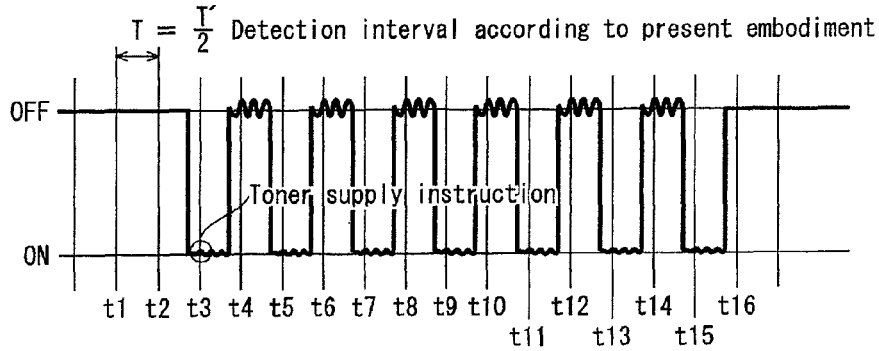
FIG. 6C is a view drawn for illustrating the toner supply determination processing performed by the image forming apparatus 1 according to the present embodiment.

FIG. 6C is a diagram showing signals sequentially output from the magnetic reed switch according to the present embodiment.

As mentioned above, in the present embodiment, the detection interval T satisfies T=T'/2. Upon detection of an ON signal, the control unit checks the detected signal obtained in the previous period and in the two periods before the detected ON signal to determine whether or not the detected ON signal indicates the On-edge. Specifically, it is determined that the detected ON signal indicates the On-edge only when the detected signals obtained in the previous period and in the two periods before the detected ON signal both indicate OFF.

The magnetic reed switch continues to output an OFF signal until a time point t2, and at a time point t3, outputs an ON signal as a result of the toner level indicator plate having swung down along with the magnet. Subsequently, the motor situated close to the magnetic reed switch is driven to rotate. Then, the magnetic reed switch sequentially outputs an ON/OFF signal at every period T' of the control pulse signal.

Then, as shown in FIG. 6C, the control unit detects an ON signal at the time point t3, and time points t5, t7, t9, t11, t13, and t15. Regarding the ON signal detected at the time point t3, the signals detected in the previous period and the two periods before the time point t3 both indicate OFF. On the other hand, regarding the ON signals detected at the time points t5, t7, t9, t11, t13, and t15, the signal detected in the previous period of each of the detected ON signals indicates OFF. The signal detected in the two periods before each of the time points t5, t7, t9, t11, t13, and t15 indicates ON.

Accordingly, the control unit determines that only the ON signal detected at the time point t3 indicates the On-edge. The control unit also determines that the ON signals detected at the time points t5, t7, t9, t11, t13, and t15 are output due to the noise caused by the rotational movement of the motor.

With the above arrangement, the image forming apparatus of the present embodiment is enabled to instruct the toner supply from the toner cartridge to the toner storage unit only at the time point t3 when the amount of toner that remains in the toner storage unit has decreased. As a result, the toner is prevented from being fed in error from the toner cartridge to the toner storage unit despite the fact that the toner storage unit is filled with the adequate amount of toner.

Note that in the present embodiment it is attributed to the decrease in the toner that the signal output from the magnetic reed switch is switched to ON at one time point after remaining OFF for more than two successive periods. That is, the switching of the detected signal from OFF to ON occurs because the toner level indicator plate 36 along with the magnet 37 has swung down as the amount of toner that remains decreases. The switching of the detected signal from OFF to ON cannot occur due to the rotational movement of the motor. Accordingly, it is determined that the ON signal detected at the time point t3 of FIG. 6C is output due to the decrease in the toner that remains.

<Modifications>

The present invention has been described based on, but is by no means limited to, the above-described embodiments. Modifications such as the following may be implemented within the scope of the present invention.

(1) In the above embodiment, the intervals T at which a signal output from the magnetic reed switch is detected is set to be half of a period T' of the control pulse signal used for driving the motor situated close to the magnetic reed switch. However, the detection interval T used in the present invention is not limited to the above embodiment, and may be less than half of the period T' of the control pulse signal used for driving the motor.

For example, the detection interval T may be set to satisfy T=T'/3. In this case, upon detection of an ON signal (in the current period), the control unit determines whether or not the detected ON signal indicates the On-edge with use of the detected signals obtained over the last three periods. Specifically, a description is given of the case where, although the detected signals obtained in the previous period or in the two periods before the current period indicates OFF, the detected signal obtained in the three periods before the current period indicates ON. In this case, the control unit determines that the ON signal detected in the current period merely indicates the noise caused by the motor, not the On-edge due to the decrease in the toner.

Similarly to the case of the above embodiment, the detection interval T may be set to satisfy T=T'/N, where N is an integer two or greater. In such a case where T=T'/N (where N is an integer two or greater), upon detection of an ON signal (in the current period), the control unit determines whether or not the detected ON signal indicates the On-edge with use of the detected signals obtained over the last N periods. Specifically, a description is given of the case where, although the detected signals obtained over a time period from the previous period to the (N−1) periods before the current period include an OFF signal, the detected signal obtained in the N periods before the current period indicates ON. In this case, the control unit determines that the ON signal detected in the current period merely indicates the noise caused by the motor, not the On-edge due to the decrease in the toner.

(2) In the above embodiment, the motor situated close to the magnetic reed switch is used for actuating the feed screw provided for the adjacent color. However, the motor situated close to the magnetic reed switch is of course not limited to the above embodiment.

The objective of the present invention is to enable the magnetic reed switch to detect the toner that remains in the toner buffer without being affected by the motor, even when the motor is situated close to the magnetic reed switch. In view of the above objective, if it is necessary to use the motor that is present within a sensing range of the magnetic reed switch and affects magnetic sensing of the magnetic reed switch by causing the noise, the detection interval of the magnetic reed switch should be set in accordance with the period of the control pulse signal used for driving the motor.

(3) In the description of the above embodiment, the full-color image forming apparatus is taken as an example. However, the image forming apparatus of the present invention is not limited to the full-color image forming apparatus, and may be a black-and-white image forming apparatus. In the black-and-white image forming apparatus also, the erroneous detection due to the noise of the motor occurs if the motor is situated close to the magnetic reed switch detecting the toner that remains in the toner buffer. By applying the present invention in such a black-and-white image forming apparatus, the magnetic reed switch is enabled to appropriately detect the toner that remains in the toner buffer.

(4) The magnetic reed switch used in the above embodiment outputs an ON signal when the magnet is moved downward toward the magnetic reed switch, and outputs an OFF signal when the magnet is moved upward away from the magnetic reed switch. However, it is possible to use a magnetic reed switch configured to output signals opposite to the above.

(5) The present invention may be any combination of the above embodiment and modifications.

SUMMARY

The above embodiment and modifications show merely some aspects of the present invention for solving the problems described in the Background Art. The above embodiment and modifications are summarized as follows.

One aspect of the present invention provides an image forming apparatus comprising: a buffer configured to temporarily store therein toner supplied from a toner cartridge and to be fed to a developing unit; a magnetic reed switch configured to sense magnet variation occurring in a sensing range and sequentially output signals each indicating a result of the sensing; a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down; a detection unit configured to detect, at equal intervals, each signal output from the magnetic reed switch, each interval being equal to one-Nth of a period of a control pulse signal used for driving a motor positioned within the sensing range, N being an integer two or greater; and a determination unit configured to determine, when a signal detected by the detection unit in a current period indicates that the magnet reed switch has sensed magnetic variation, whether the signal is output due to a toner shortage or the driving of the motor, with use of signals detected by the detection unit over the last N periods.

According to the above structure, the signal output from the magnetic reed switch is detected at the intervals determined by the period of the control pulse signal used for driving the motor that affects the signal output from the magnetic reed switch. Accordingly, it is appropriately determined whether the current signal from the magnetic reed switch is output under the influence of the magnet attached to the toner level indicator plate (i.e. a decrease in the toner) or the driving of the motor. This prevents an erroneous detection made by the magnetic reed switch from triggering the toner supply in error from the toner cartridge to the buffer. As a result, the toner supply is appropriately controlled.

Another aspect of the present invention provides a full-color image forming apparatus comprising for each of a plurality of colors: a toner storage unit configured to temporarily store therein toner supplied from a toner cartridge and to be fed to a developing unit, including: a buffer configured to temporarily store therein toner; a magnetic reed switch configured to sense magnet variation occurring in a sensing range and sequentially output signals each indicating a result of the sensing; a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down; a motor; and a feed unit configured to supply the toner stored in the buffer to the developing unit in response to driving of the motor; a detection unit configured to detect, at equal intervals, each signal output from the magnetic reed switch, each interval being equal to one-Nth of a period of a control pulse signal used for driving a motor positioned within the sensing range, N being an integer two or greater; and a determination unit configured to determine, when a signal detected by the detection unit in a current period indicates that the magnet reed switch has sensed magnetic variation, whether the signal is output due to a toner shortage or the driving of the motor, with use of signals detected by the detection unit over the last N periods.

According to the above structure, even the full-color image forming apparatus in which the toner cartridges, the buffers, the motors, the developing units for the respective colors are disposed close to each other and therefore the magnetic reed switch is inevitably affected by the motor.

Here, the magnetic reed switch may be configured to output a signal indicating ON when the magnet is present within the sensing range of the magnetic reed switch, and output a signal indicating OFF when the magnet is outside the sensing range of the magnetic reed switch. The detection unit may detect a signal output from the magnetic reed switch at every half period of the control pulse signal. The determination unit may determine that the signal indicating ON detected in the current period is output due to the toner shortage, when a signal detected in a previous period and a signal detected in two periods before the current period both indicate OFF, and determine that the signal indicating ON is output due to the driving of the motor when the signal detected in the previous period indicates OFF and the signal detected in the two periods before the current period indicates ON.

According to the above structure, the number of the detections made by the detection unit is reduced, while the erroneous detection made by the magnetic reed switch is reliably prevented from triggering the toner supply in error from the toner cartridge to the buffer. As a result, the toner supply is appropriately controlled. Thus, the toner supply is appropriately controlled.

Here, the full-color image forming apparatus may further comprise: a supply control unit configured to supply the toner from the toner cartridge to the buffer; and a control unit configured to instruct the supply control unit to supply the toner if the determination unit determines that the signal is output due to the toner shortage, and not to instruct the supply control unit to supply the toner if the determination unit determines that the signal is output due to the driving of the motor.

According to the above structure, in the case where the magnetic reed switch detects the signal indicating ON output due to the noise of the motor, the toner is prevented from being supplied in error from the toner cartridge to the buffer. As a result, the toner is supplied only at an appropriate time when the amount (i.e. liquid level) of the toner that remains in the buffer decreases.

The present invention can be used in the manufacturing industry of image forming apparatuses as a mechanism for realizing a proper detection of toner that remains in a toner buffer and an appropriate toner supply from a toner cartridge to a toner buffer.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a buffer configured to temporarily store therein toner supplied from a toner cartridge and to be fed to a developing unit;

a magnetic reed switch configured to sense magnet variation occurring in a sensing range and sequentially output signals each indicating a result of the sensing;

a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down;

a detection unit configured to detect, at equal intervals, each signal output from the magnetic reed switch, each interval being equal to one-Nth of a period of a control pulse signal used for driving a motor positioned within the sensing range, N being an integer two or greater; and a determination unit configured to determine, when a signal detected by the detection unit in a current interval indicates that the magnet reed switch has sensed magnetic variation, whether the signal in the current interval is output due to a toner shortage or the driving of the motor, by comparing the signal in the current interval with signals detected by the detection unit over the last immediately preceding successive N intervals.

2. The image forming apparatus according to claim 1, further comprising:

a supply control unit configured to supply the toner from the toner cartridge to the buffer; and a control unit configured to instruct the supply control unit to supply the toner if the determination unit determines that the signal is output due to the toner shortage, and not to instruct the supply control unit to supply the toner if the determination unit determines that the signal is output due to the driving of the motor.

3. The image forming apparatus according to claim 1, wherein the determination unit sends a toner supply instruction when the magnetic reed switch at the current interval is detected to be "ON" and detections of the magnetic reed switch over the last immediately preceding successive two intervals are "OFF" and "OFF", respectively.

4. The image forming apparatus according to claim 3, wherein the determination unit does not send a toner supply instruction when the magnetic reed switch at the current interval is detected to be "ON" and detections of the magnetic reed switch over the last immediately preceding successive two intervals are "ON" and "OFF", respectively.

5. A full-color image forming apparatus comprising for each of a plurality of colors:

a toner storage unit configured to temporarily store therein toner supplied from a toner cartridge and t be fed to a developing unit, the toner storage unit comprising:

a buffer configured to temporarily store therein toner;

a magnetic reed switch configured to sense magnet variation occurring in a sensing range and sequentially output signals each indicating a result of the sensing;

a toner level indicator plate disposed within the buffer to swing up and down about a fixed edge in response to a change in a level of the toner that remains in the buffer, the toner level indicator plate having a magnet on a free edge thereof, the magnet being made to reach the sensing range in a state where the toner level indicator plate has swung down;

a motor; and a feed unit configured to supply the toner stored in the buffer to the developing unit in response to driving of the motor;

a detection unit configured to detect, at equal intervals, each signal output from the magnetic reed switch, each interval being equal to one-Nth of a period of a control pulse signal used for driving a motor of an adjacent toner storage unit in the full-color image forming apparatus, the motor of the adjacent toner storage unit positioned within the sensing range of the detection unit, and N being an integer two or greater; and a determination unit configured to determine, when a signal detected by the detection unit in a current interval indicates that the magnet reed switch has sensed magnetic variation, whether the signal in the current interval is output due to a toner shortage or the driving of the motor positioned within the sensing range, with use of signals detected by the detection unit over the last immediately preceding successive N intervals.

6. The full-color image forming apparatus according to claim 5, further comprising:

a supply control unit configured to supply the toner from the toner cartridge to the buffer; and a control unit configured to instruct the supply control unit to supply the toner if the determination unit determines that the signal is output due to the toner shortage, and not to instruct the supply control unit to supply the toner if the determination unit determines that the signal is output due to the driving of the motor.

7. The full-color image forming apparatus according to claim 5, wherein the magnetic reed switch is configured to output a signal indicating ON when the magnet is present within the sensing range of the magnetic reed switch, and output a signal indicating OFF when the magnet is outside the sensing range of the magnetic reed switch, the detection unit detects a signal output from the magnetic reed switch at every half period of the control pulse signal, the determination unit determines that the signal indicating ON detected in a current interval is output due to the toner shortage, when a signal detected in a previous interval and a signal detected in two intervals before the current interval both indicate OFF, and determines that the signal indicating ON is output due to the driving of the motor when the signal detected in the previous interval indicates OFF and the signal detected in the two intervals before the current interval indicates ON.

8. The full-color image forming apparatus according to claim 7, further comprising:

a supply control unit configured to supply the toner from the toner cartridge to the buffer; and a control unit configured to instruct the supply control unit to supply the toner if the determination unit determines that the signal is output due to the toner shortage, and not to instruct the supply control unit to supply the toner if the determination unit determines that the signal is output due to the driving of the motor.

* * * * *